US008650783B2

(12) United States Patent
Brown et al.

(10) Patent No.: US 8,650,783 B2
(45) Date of Patent: Feb. 18, 2014

(54) ROAD SIGN APPARATUS

(76) Inventors: Herman Brown, Roswell, GA (US); John Evans, Sandy Springs, GA (US)

( * ) Notice: Subject to any disclaimer, the term of this patent is extended or adjusted under 35 U.S.C. 154(b) by 0 days.

(21) Appl. No.: 13/019,852

(22) Filed: Feb. 2, 2011

(65) Prior Publication Data

US 2012/0192468 A1 Aug. 2, 2012

(51) Int. Cl.

| | |
|---|---|
| ***G09F 7/00*** | (2006.01) |
| ***G09F 21/04*** | (2006.01) |
| ***G09F 15/02*** | (2006.01) |
| ***E01F 9/00*** | (2006.01) |

(52) U.S. Cl.
USPC ..... 40/612; 40/587; 40/607.1; 40/607.01; 40/607.04; 116/63 P; 116/63 R

(58) Field of Classification Search
USPC ..... 40/612, 587, 607.1, 607.01, 607.04; 116/63 P, 63 R
See application file for complete search history.

(56) References Cited

U.S. PATENT DOCUMENTS

| | | | | |
|---|---|---|---|---|
| 3,292,569 | A * | 12/1966 | Trigilio | 359/525 |
| 3,564,742 | A * | 2/1971 | Gilmoure et al. | 40/587 |
| 3,680,448 | A * | 8/1972 | Ballingall et al. | 52/169.12 |
| 5,340,068 | A * | 8/1994 | Sarkisian et al. | 248/188.6 |
| 6,318,011 | B1 * | 11/2001 | McCudden | 40/607.1 |
| 6,477,800 | B1 * | 11/2002 | Payne | 40/582 |
| 2009/0084304 | A1 * | 4/2009 | Hatcher | 116/28 R |

* cited by examiner

*Primary Examiner* — Syed A Islam

(57) ABSTRACT

A road sign mounting apparatus for displaying a road sign attached to a mounting bracket. The road sign mounting apparatus is adapted for being carried by a circular base having an open interior and a rim, and an upper profile and lower profile. The road sign mounting apparatus comprises a body and a plurality of legs carried by and extending outward from the body. Each of the plurality of legs is intended for being carried by the circular base. A road sign support is pivotally carried by the body and has a first position wherein the road sign support is carried beneath the upper profile of the circular base when carried by the circular base and a second position wherein the road sign support extends in a general vertical direction intersecting the plane defined by the upper profile of the circular base. The road sign support includes a locking mechanism for locking the road sign support in the second position. The road sign mounting apparatus may be carried by a tire having reflective surface.

14 Claims, 9 Drawing Sheets

ROAD SIGN APPARATUS

FIELD OF THE INVENTION

This invention relates to a road sign display and more particularly to a system which utilizes a mounting structure which may transition from a retracted stowed position to an upright position for releasably receiving and displaying a road sign.

Road signs are utilized to communicate information to drivers regarding conditions which lie ahead. Such conditions may include the following: road work ahead, right lane closed, flooding ahead, etc. These signs may be roll-up or rigid. Typically roll-up signs are utilized for temporary placement such as "men at work" and are routinely carried by the utility trucks utilized by the workers when transporting themselves to the specific roadside worksites. The positioning of the signs on a road by the workers must be done in a manner which displays the cautionary road sign at a height predetermined by respective regulatory agencies. This height is generally twelve inches between the ground and the base of the sign. Furthermore, when positioned, these road signs and their respective stands must be constructed in a manner enabling them to maintain their stability even during tumultuous weather conditions such as rain and wind which may develop during the duration of the event which requires the posting of the respective sign.

Various stands have been developed and are utilized for displaying road side signs. Some of these sign stands are manufactured by Bone Safety Signs of Alpharetta Ga. under the SafeZone Series. Certain stands include telescopic legs extending from a central mount. Additional stands include spring coils which add additional weight and redundancy to compensate for increased wind loads which the signs may be subject. The spring coils function to maintain the upright positioning of the road signs and withstand the various twisting of the signs which may arise. A mounting bracket as shown in U.S. Pat. No. 4,888,894 entitled "Stand for Safety Sign or the Like" previously issued to the inventor may be utilized for releasably mounting a respective sign to a mount.

As temporary signs are generally used on site by workers, the signs and mounts are typically carried by the vehicles which transport the workers. Accordingly, to limit the space occupied by these signs, some signs are rollups and the respective mounts are designed to be compact when not deployed. For instance, in some configurations, the legs are pivotally mounted with a central bracket support and may fold into a stowable configuration. While suitable for their intended purpose, other alternative configurations have been developed for further minimizing space requirements.

For instance, an alternative design identified as the Rubber Base System also sold by Bone Safety Signs consists of a unitary rubberized mat with a centralized mounting system adapted to receive a mast attachment for integrating a sign with the rubberized base. The rubber base weighs approximately thirty-eight pounds and is stackable. The heft of the base is required in order to ensure stability of the sign during inclement weather conditions. While suitable for its intended purpose in having a low profile and providing for a stable base, the primary hindrance of such a base is the weight, especially considering the costs associated with shipping and handling the heavy bases. As multiple stands are required to be displayed at any one particular work site, fleets of utility trucks require a large number of signs and mounts. Shipping the required number of rubber mats becomes cost prohibitive.

Accordingly it is desirable to develop a road sign mounting apparatus which is lightweight, stowable and convenient to use while also providing for a stable base to withstand weather conditions.

SUMMARY OF THE INVENTION

The above objectives are accomplished according to the present invention by providing a road sign mounting apparatus for displaying a road sign which is attached to a mounting bracket. The road sign mounting apparatus is adapted for being carried by a circular base having an open interior and a rim, and an upper profile and lower profile. The road sign mounting apparatus comprises a body and a plurality of legs carried by and extending outward from the body. Each of the plurality of legs is intended for being carried by the circular base. A road sign support is pivotally carried by the body and has a first position wherein the road sign support is carried beneath the upper profile of the circular base when carried by the circular base and a second position wherein the road sign support extends in a general vertical direction intersecting the plane defined by the upper profile of the circular base. The road sign support includes a locking mechanism for locking the road sign support in the second position.

BRIEF DESCRIPTION OF THE DRAWINGS

The construction and design to carry out the invention will hereinafter be described together with other feathers thereof. The invention will be more readily understood from a reading of the following specification and by reference to the accompanying drawings forming a part thereof, wherein an example of the invention is shown and wherein.

DETAILED DESCRIPTION OF PREFERRED EMBODIMENTS

Referring now in more detail to the drawings, the invention will now be described in more detail.

Figure 1:
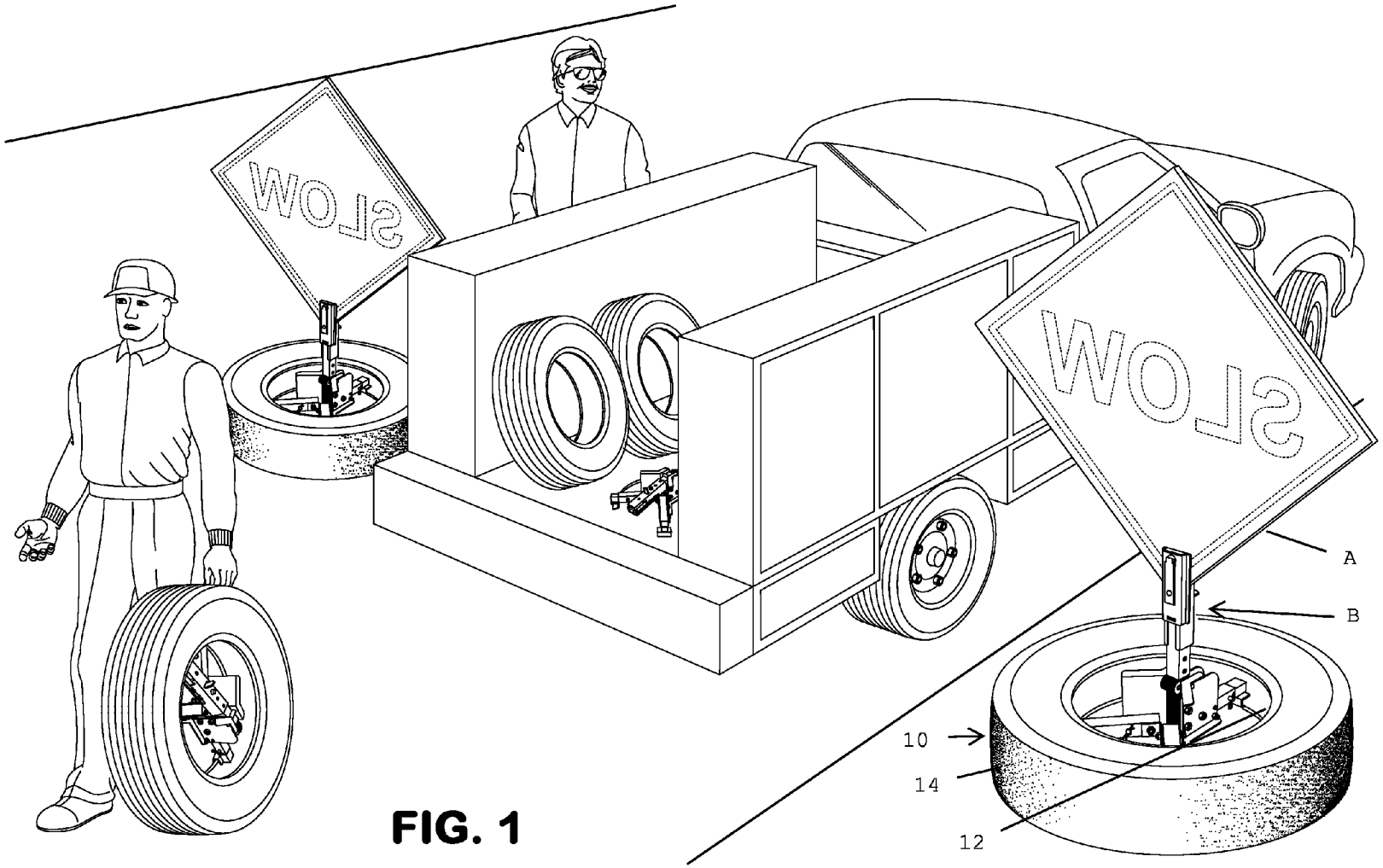
FIG. 1 is a perspective drawing illustrating a preferred embodiment of an apparatus for mounting a road sign in accordance with the present invention in a deployed and ready for deployment positions.

FIG. 1 identifies an intended environment for utilizing the apparatus for mounting a road sign in accordance with the present invention. A typical environment consists of workers utilizing a utility truck for visiting a work site. As is customary, temporary work signs A are positioned around the work site identifying to oncoming traffic of the conditions ahead. As shown in FIG. 1 the apparatus for mounting a road sign is positioned within the interior of a circular base 10. In the preferred configuration, a tire is preferably utilized as the base of the road sign mounting apparatus B providing stability for the mounted sign. As shown in FIG. 1 it is intended that the road sign mounting apparatus be carried by the interior rim or bead 12 of the circular base and having a profile which fits within the interior of the circular base. As tires are common in the fleet management departments of utility trucks, no additional component is required to be purchased by the department for providing a base for the apparatus mounting the road sign. The tire preferably includes an upper sidewall, a lower side wall, and central portion commonly comprised of a tread pattern.

Furthermore as shown in FIG. 1, the mounting apparatus is easily positioned to its desired location merely via the rolling of the associated tire 10. This ease of placement is an advantage over the heavy rubber mat which is currently utilized as an alternative mounting apparatus. As shown in FIG. 1, the mounting apparatus utilizes the entire circumferential area of the tire providing for maximum contact with the ground combating any twisting exhibited by the sign induced by the ambient environment. This configuration provides enhanced stability by maximizing the footprint area of the sign mount and consequently the frictional contact area between the mounting structure and the ground. Additionally as shown in FIG. 1, in the preferred embodiment, the tire has a reflective surface area 14 providing for enhanced visual perception by an oncoming vehicle. The reflective surface may be established either via paint, or a reflective band secured around the tire.

Figure 2:
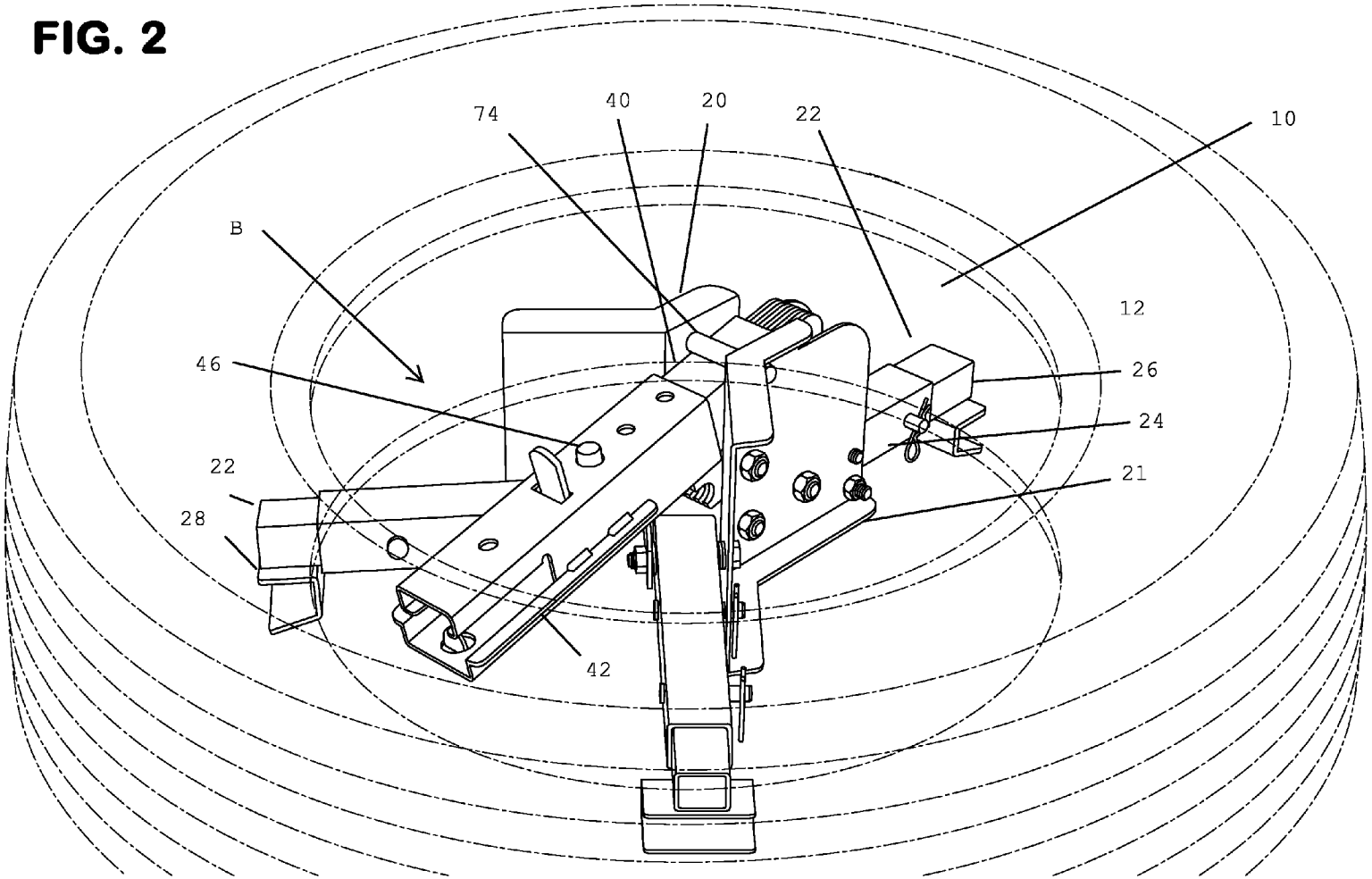
FIG. 2 is a perspective drawing illustrating a preferred embodiment of an apparatus for mounting a road sign of the present invention housed within a tire for storage and for deployment.
Figure 3:
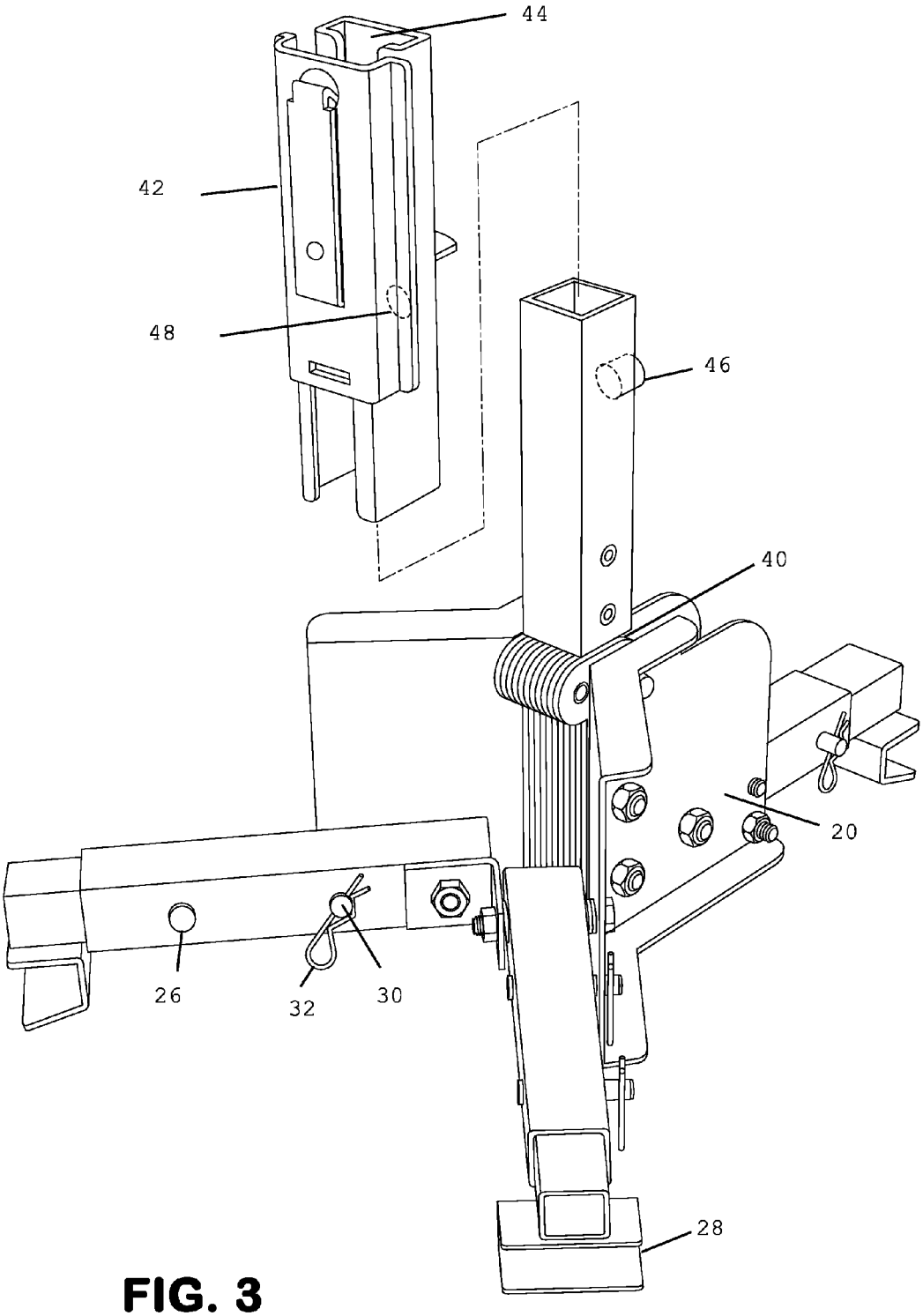
FIG. 3 is a perspective drawing illustrating a preferred embodiment of an apparatus for mounting a road sign of the present invention in position for receiving a mounting bracket suitable for releasably mounting a road sign.
Figure 3A:
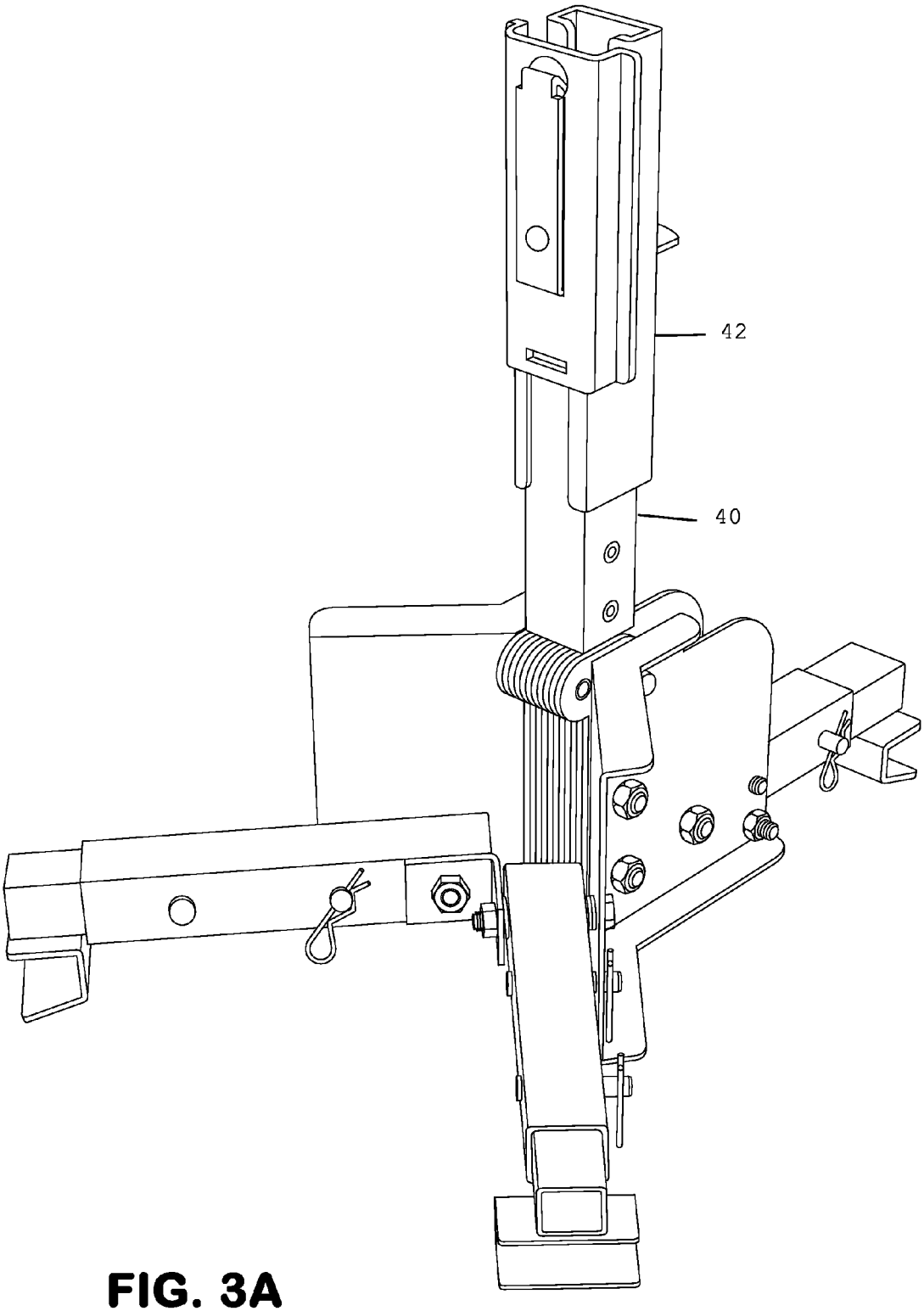
FIG. 3A is a perspective drawing illustrating a preferred embodiment of an apparatus for mounting a road sign of the present invention as shown in FIG. 3 integrated with a mounting bracket suitable for releasably mounting a road sign.

FIGS. 2, 3 and 3A further exemplify the preferred embodiment of the present invention. As shown in FIG. 2, the road sign mounting apparatus B includes a central body 20 which is preferably received within the interior of the tire 10. Central body 20 is preferably carried by a central base 21. A plurality of legs 22 are carried by central body 20 and extend outward away from central base 21. Preferably, a respective leg 22 includes a primary member 24 and a secondary member 26 telescopically housed within primary member 24. When desired, the secondary member 26 forms an extension of leg 22 enabling mounting apparatus B to be carried by tires of different dimensions. As shown in FIGS. 3 and 3A, the respective primary member 24 and associated secondary member have holes 26 defined within their respective bodies. The respective holes of a secondary member and primary member align for receiving a securing member, such as pin 30 secured by cotter pin 32, for establishing the respective length of the leg 22. As shown in FIGS. 2, 3 and 3A, the plurality of legs 22 preferably are not axially aligned. Such a configuration further withstands any twisting exhibited by the road sign via wind. In the preferred embodiment, at least three separate legs are present facilitating in the transference of torquing force from the road sign to separate axises.

Each respective leg includes a rim receptacle 28 for receiving a portion of the round base. Preferably, rim receptacle 28 is an open faced "C" shaped fixture having an open end for receiving a rim of the tire into the interior of the receptacle having a top, rear, and bottom portions defining the frontal opening as shown in FIG. 2. In the preferred embodiment, the receptacle 28 is carried beneath a respective leg generally planar with central base 21. In this manner, the road sign mounting apparatus B may contact the surface of the road such that the apparatus is supported by a plurality of rim receptacles and the central base 21. Furthermore, utilizing the weight of the tire secures the road sign mounting apparatus B in contact with the ground should the affiliated sign experience gusts of wind and the like.

Positioning of the road sign mounting apparatus within the tire interior is achieved by engage the rim of the tire via the tire receptacles. The respective legs will be in an inclined position when the rim is engaged. Once the receptacles are in place, the central body and legs are manipulated downward further extending the tire receptacles in a horizontal position, the resiliency of the tire rim compresses against the receptacles maintaining the apparatus in place.

As shown in FIGS. 2, 3 and 3A, road mounting apparatus B also includes road sign support 40 carried by central body 20. As will be discussed in further detail with respect to FIGS. 4A-4E, road sign support 40 is pivotally carried by central body 20 operable from a first stowed position wherein the road sign support 40 is received within the interior of the tire to a second erect position wherein the road sign support 40 intersects a plane as defined by the upper profile of the tire for receiving a sign and displaying the sign. As shown in FIG. 2, road sign support 40 pivots downward to a stowed position wherein the road sign support and associated road sign mounting bracket 42 fit within the interior of tire 10.

As shown in FIGS. 2, 3 and 3A, road sign support 40 is adapted for receiving road sign mounting bracket 42. Road sign mounting bracket 42 is preferably of similar construction as the mounting bracket depicted in U.S. Pat. No. 4,888,894 entitled "Stand for Safety Sign or the Like". Road sign mounting bracket 42 is configured for receiving a road sign with its interior 44. Road sign support 40 includes a latching mechanism 46 for releasably securing the road sign mounting bracket 42 in secure relationship with road sign support 40. In the preferred embodiment, latching mechanism 46 is preferably a retractable boss 46 which may be depressed enabling the road sign mounting bracket 42 to slide over the exterior of the road sign support. A boss receptacle 48 is defined through the exterior of the road sign mounting bracket for matingly receiving retractable boss 46 enabling the retractable boss to engage road sign mounting bracket securing the road sign mounting bracket in place as shown in FIG. 3A. For releaseable removal, the retractable boss 46 is depressed freeing the road sign mounting bracket.

Figure 4A:
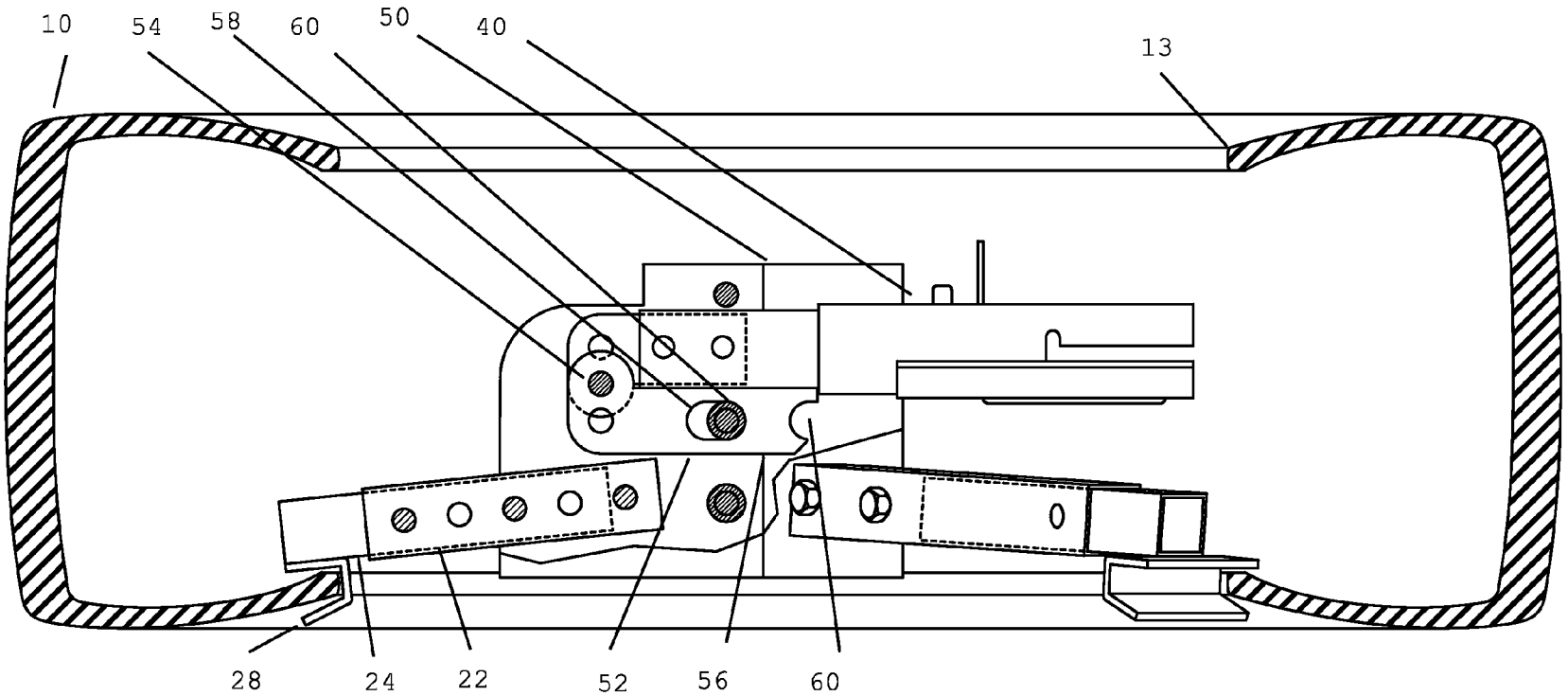
FIGS. 4A-4E illustrate the operation of the apparatus for mounting a road sign from a stowed collapsible position to fully erect position ready to receive a road sign.

FIGS. 4A-4E illustrate the operation of the road sign support 40. Road sign support 40 preferably includes an upper portion 50 and a lower portion 52. The upper portion 50 and lower portion 52 are pivotally connected at hinge 54 enabling the upper portion to be generally horizontal in a stored position as shown in FIG. 4A. Lower portion 52 includes sliding guide member 56 having a sliding slot 58 which is slidably carried by central body 20 by the utilization of a sliding slot 58 and a sliding pin 60 fixedly carried by central body 20. This configuration provides road sign support 40 with both horizontal and vertical movement.

As shown in FIG. 4A road sign support 40 is slid to its left most position with respect to central base 20 with sliding pin 60 engaging the right most portion of sliding slot 58 of sliding guide member preparing the apparatus for deployment. This position enables the road sign support 40 and affiliated road sign mounting bracket 42 to clear the interior of tire rim 13. As previously noted, the bottom of a road sign is required to be at least a foot above the ground. Accordingly, the preferred height of road sign mounting apparatus B is at least twelve inches. For storage, as shown in FIG. 2 the sliding guide member would be positioned such that the sliding pin 60 engages the left most portion of sliding slot 58 of sliding guide member 56. In this manner the upper portion of sign mounting bracket 42 is received within the interior of tire 10 wherein the upper rim 13 would function as a buffer during storage of the apparatus preventing damage to the device when stored.

Figure 4B:
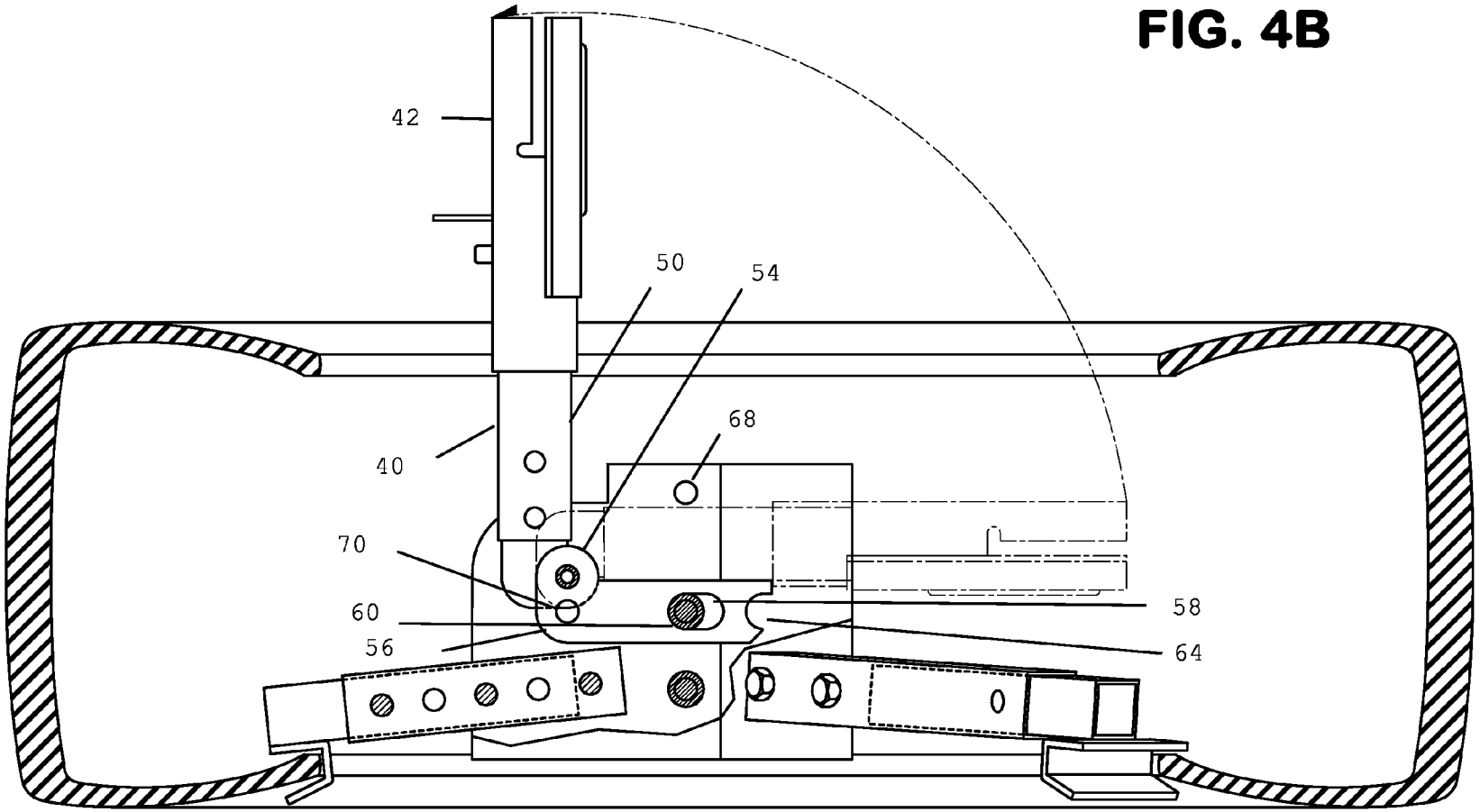
Figure 4C:
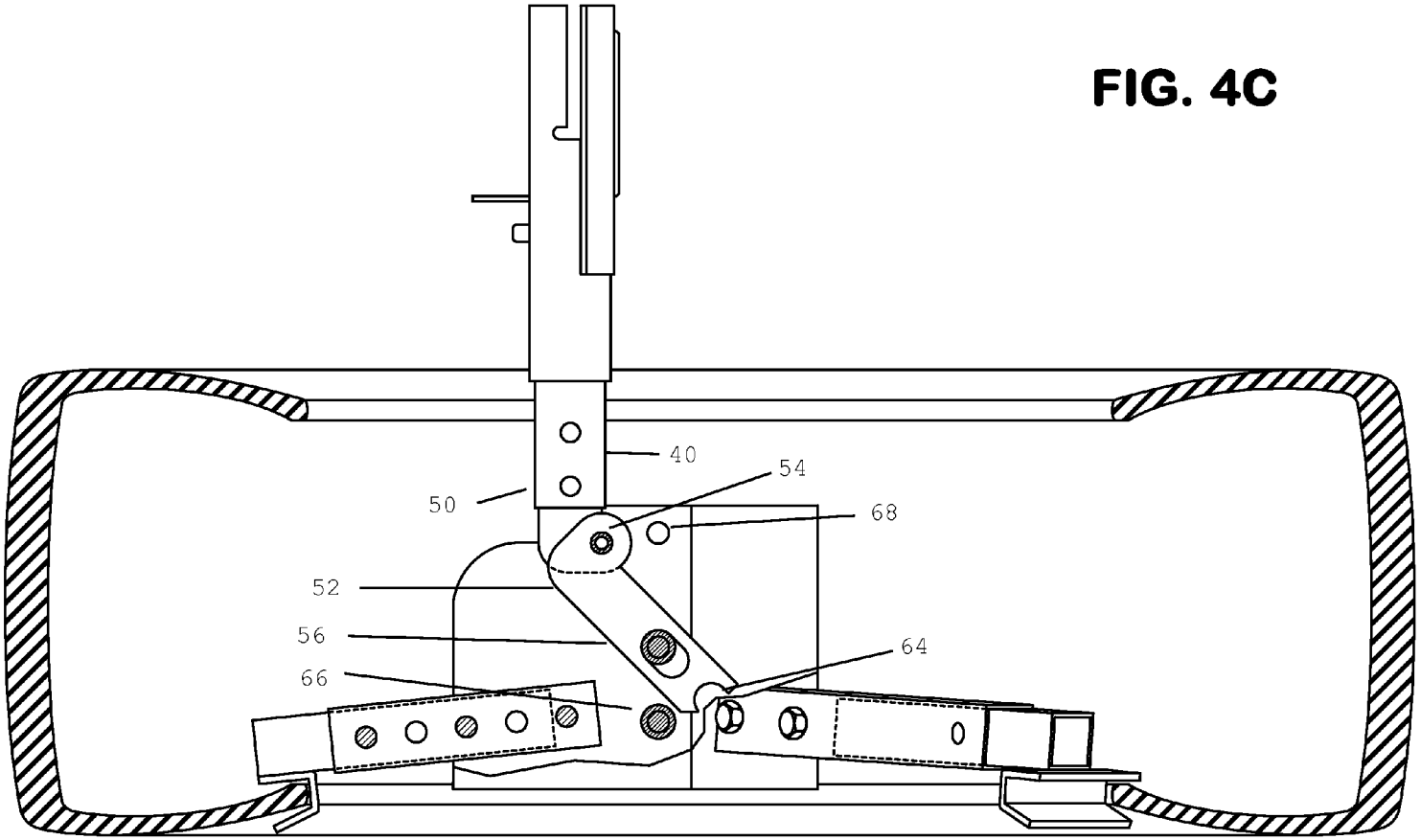
Figure 4D:
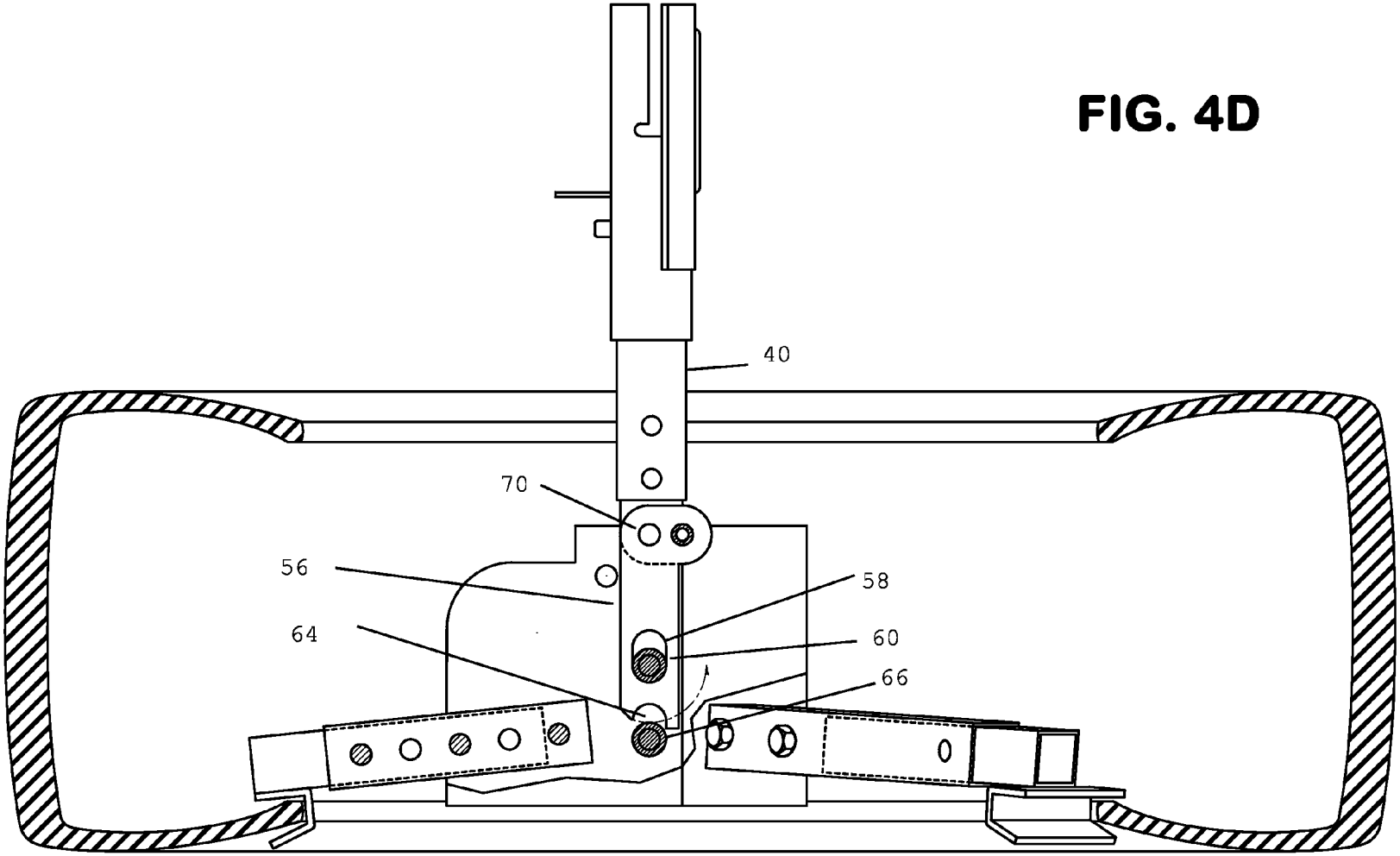

As shown in FIG. 4B-4E, once the road sign mounting bracket 42 clears the interior and the upper rim 13, the road sign support is ready for deployment. The upper portion 50 pivots to a vertical position as shown in FIG. 4B. Further vertical extension is provided by the sliding guide member 56 pivoting around the sliding pin 60. Locking mechanism 62 preferably includes a locking notch 64 defined within the lower portion of sliding guide member 56 for receiving a first locking pin 66. As shown in FIG. 4C, the lower portion of sliding guide member 56 will not clear first locking pin 66 as the road sign support is pivoting to an upright position. As shown in FIG. 4D, in order for the road sign support to achieve its vertical deployment position, the road sign support must be manipulated vertically such that sliding pin 60 engages the lowermost portion of sliding slot 58.

Figure 4E:
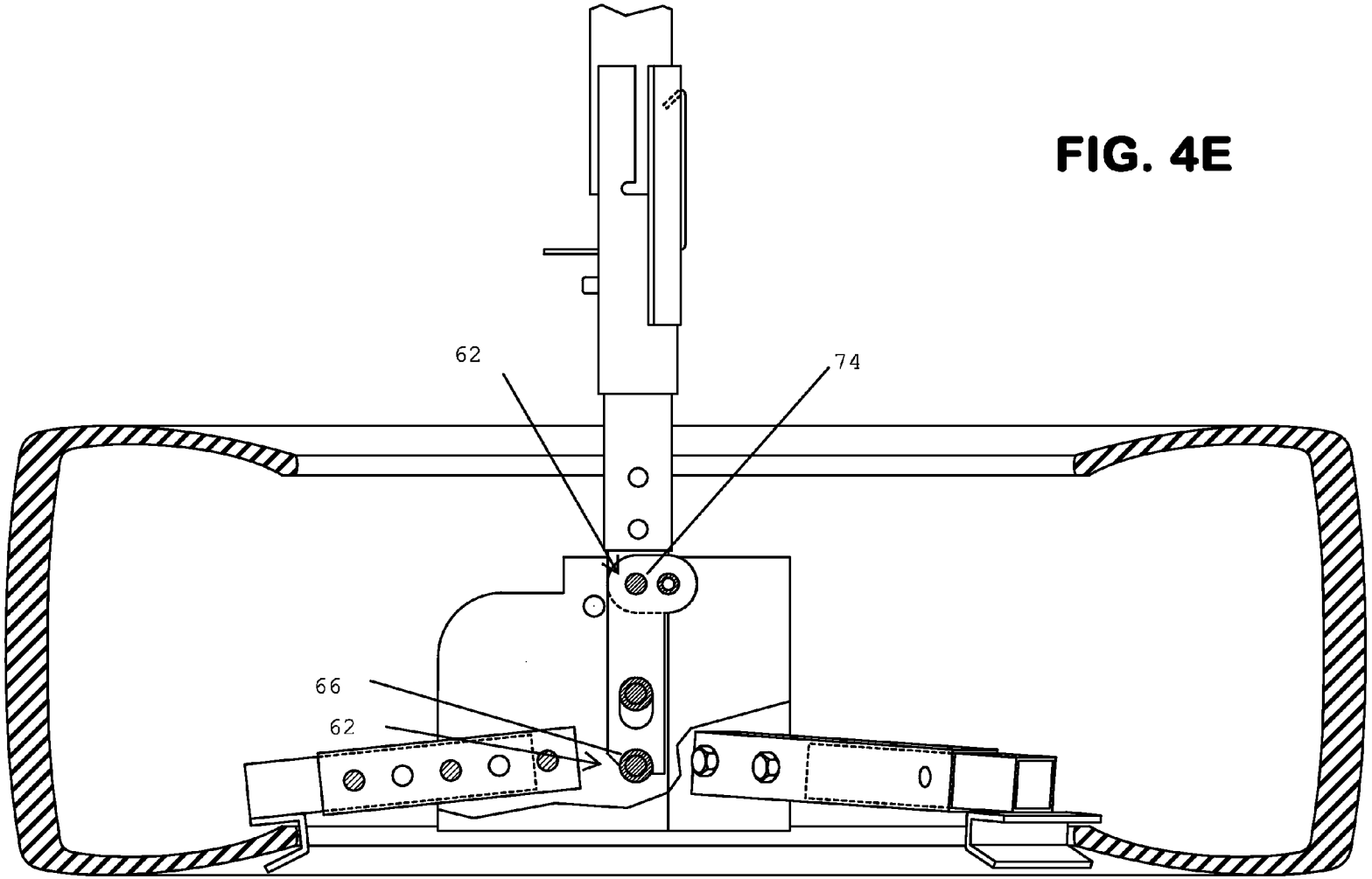

As shown in FIG. 4E, once the sliding guide member 56 clears first locking pin 66, the road sign support is lowered such that locking notch 64 engulfs first locking pin 66 stabilizing road sign support in the vertical deployed position. To provide additional security, central base 20 includes a second locking pin receptacle 68 and sliding guide member 56 also includes a second locking pin receptacle 70 which concentrically aligns with second locking pin receptacle 68. Once road sign support is in the vertical deployed position, second locking pin 74 is positioned via the second locking pin receptacles for locking the road sign support in the vertical position. Locking mechanism 62 may include just the locking notch 64, or second locking pin 74, but preferably includes both.

As shown in FIG. 2, second locking pin 74 may also be utilized for securing road sign support in the horizontal position when stowed. In this manner, locking pin 74 is received within the second locking pin receptacles located within the central 20 such that the second locking pin traverses the width of the road sign support and works in conjunction with the upper rim of the tire for securing the road sign apparatus in a position which is below the profile of the upper portion of the tire, thereby protecting the apparatus from damage while stowed.

Thus it may be seen that an advantageous design may be had for road sign display according to the present invention. A lightweight road sign support is readily stored and utilized with pre-existing tires commonly found in fleets of utility trucks. The utilization of the tires as a base provides for a three hundred and sixty degree support of the associated road sign providing for enhanced structural support to withstand tumultuous weather conditions. An associated road sign is readily attached and removed utilizing a sign mounting bracket for easy assembly and break down. Additionally, configuring the road sign support for positioning within the tire during storage reduces the footprint required for storage by utilizing the footprint already associated with the tire.

We claim:

1. A road sign mounting apparatus for displaying a road sign attached to a mounting bracket said road sign mounting apparatus comprising:

a circular base having a rim and an interior encircled by said rim;

a body;

a plurality of legs carried by said body and extending outward from said body;

each of said plurality of legs carried by said circular base and extending from said body within said interior of said base towards said rim;

a road sign support pivotally carried by said body for having a first position wherein said road sign support is carried beneath the upper profile of said circular base when carried by said circular base and a second position wherein said road sign support extends in a general vertical direction intersecting said plane defined by said upper profile of said circular base;

said road sign support including a locking mechanism for locking said road sign support in said second position;

each respective leg includes a rim receptacle for receiving said rim of said circular base thereby locking said body in position within the interior of said circular base; and a sliding guide member which slides along said body, said road sign support pivoting from a generally horizontal position to a generally vertical position, and also said sliding guide member sliding along a general horizontal plane in a first direction enabling said road sign support being received within said rim of said circular base for storage and said sliding guide member also sliding along said general horizontal plane in a second direction enabling said road sign support to pivot to said second position wherein said road sign support may extend vertically intersecting the plane defined by the upper profile of said circular base.

2. The road sign mounting apparatus of claim 1 wherein said road sign support includes a latching mechanism adapted for releasably receiving said mounting bracket for releasably carrying a road sign.

3. The road sign mounting apparatus of claim 2 wherein said road sign support includes an upper portion carrying said latching mechanism which includes a retractable boss for matingly receiving a boss receptacle carried by said mounting bracket enabling said mounting bracket to become unlatched from said road sign support via depression of said boss.

4. The road sign mounting apparatus of claim 1 wherein said sliding guide member includes a locking notch for receiving a first locking pin carried by said body for locking said road sign support in said second position.

5. The road sign mounting apparatus of claim 1 wherein said plurality of legs includes three legs each carried by said body along a different axis.

6. An apparatus for displaying information to a motorist comprising: a road sign including indicia communicating information to a motorist; a road sign mounting bracket adapted for receiving said road sign; a road sign mounting apparatus support comprising; a central body; a plurality of legs extending out from said central body; a road sign support pivotally carried by said central body; a latching mechanism for releasably receiving said road sign mounting bracket; a tire having an upper and lower rim defining an interior; and said plurality of legs including a tire receptacle for receiving a rim of said tire securing said road sign mounting apparatus support with said tire.

7. An apparatus for receiving a road sign displaying information to a motorist comprising: a road sign mounting bracket adapted for receiving said road sign; a road sign mounting apparatus support comprising; a central body; a plurality of legs extending out from said central body; a road sign support pivotally carried by said central body; said road sign support carrying said road sign mounting bracket; a tire having an upper and lower rim defining an interior; and said plurality of legs including a tire receptacle for receiving a rim of said tire securing said road sign mounting apparatus support with said tire.

8. The apparatus of claim 7 wherein said road sign mounting apparatus support has a first position wherein said road sign support is horizontal within said interior of said tire and a second position wherein said road sign mounting apparatus has a second position wherein said road sign support is vertical within said interior intersecting a plane defined by the upper rim of said tire.

9. The apparatus of claim 7 wherein said road sign mounting apparatus support includes a latching mechanism adapted for receiving said mounting bracket for releasably carrying said mounting bracket.

10. The apparatus of claim 9 wherein said road sign mounting apparatus support includes an upper portion carrying said latching mechanism which includes a retractable boss for matingly receiving a boss receptacle carried by said mounting bracket enabling said mounting bracket to become unlatched from said road sign support via depression of said boss.

11. The apparatus of claim 7 wherein said road sign support includes a sliding guide member which slides along said body, said road sign support pivoting from a generally horizontal position to a generally vertical position, and also said sliding guide member sliding along a general horizontal plane in a first direction enabling said road sign support being received within said rim of said circular base for storage and said sliding guide member also sliding along said general horizontal plane in a second direction enabling said road sign support to pivot to said second position wherein said road sign support may extend vertically intersecting the plane defined by the upper profile of said circular base.

12. The apparatus of claim 7 wherein said plurality of legs includes three legs each carried by said body along a different axis.

13. An apparatus for receiving a road sign displaying information to a motorist having an associated mounting bracket comprising: a road sign mounting apparatus support comprising; a central body; a plurality of legs extending out from said central body; a road sign support pivotally carried by said central body; said road sign support for carrying said road sign mounting bracket; a tire having an upper and lower rim defining an interior; and said plurality of legs including a tire receptacle for receiving a rim of said tire securing said road sign mounting apparatus support with said tire.

14. The apparatus of claim 13 wherein said tire carries a reflective surface along its circumference.

* * * * *